US006283779B1

(12) United States Patent
Lung

(10) Patent No.: US 6,283,779 B1
(45) Date of Patent: Sep. 4, 2001

(54) RETENTION MEMBER FOR CABLE CONNECTOR

(75) Inventor: Jeff Lung, Hsin-Zu (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/518,612

(22) Filed: Mar. 3, 2000

(30) Foreign Application Priority Data

Jan. 28, 2000 (TW) ..... 089201589

(51) Int. Cl.[7] ..... H01R 13/15
(52) U.S. Cl. ..... 439/260; 439/495
(58) Field of Search ..... 439/329, 495, 439/67, 260

(56) References Cited

U.S. PATENT DOCUMENTS 4,778,403 * 10/1988 Ikesugi et al. ..... 439/329
5,458,506 * 10/1995 Yamaguchi et al. ..... 439/495
5,580,272 * 12/1996 Yamaguchi et al. ..... 439/495
5,904,586 * 5/1999 Takayasu ..... 439/260
6,056,572 * 5/2000 Matsumoto et al. ..... 439/260

* cited by examiner

*Primary Examiner*—Gary F. Paumen
(74) *Attorney, Agent, or Firm*—Wei Te Chung

(57) ABSTRACT

An electrical connector comprises an elongate housing, a number of terminals, and an actuator. The housing includes a top wall, a bottom wall, a pair of supporting walls projecting from lateral ends of the bottom wall and a slot for receiving a flexible printed circuit board. The bottom wall forms a pair of ribs at opposite ends thereof. Each supporting wall forms a projection at an upper side thereof and defines a recess rearwardly extending from a forward side thereof. An aperture is defined at an inner side of the recess. The actuator includes a handle with a pair of arms formed at opposite ends thereof, a cylindrical peg extending inwardly from each arm to pivotably engage with the apertures. A pressing plate extends from the handle for pressing the flexible printed circuit board against contacting portions of the terminals. A pair of latches extends from opposite junctures of the handle and the arms and each latch forms an inwardly projecting embossment for latching with the bottom wall. The arms are retained in a closed position by engagements of the projections and arms and those of the embossments and the ribs.

1 Claim, 3 Drawing Sheets

RETENTION MEMBER FOR CABLE CONNECTOR

BACKGROUND OF THE INVENTION

1. Field of the Invention

The present invention relates to a connector used for connecting a flexible printed circuit board (FPC) or a flat cable, and particularly to a zero insertion force FPC connector reliably securing the FPC in position.

2. Brief Description of the Prior Art

A conventional connector disclosed in U.S. Pat. No. 4,778,403 provides a connector which consists of a housing with a plurality of contacts received therein and an actuator. The housing includes a pair of side walls at lateral sides thereof. Each side wall is of stepped shape in a bottom thereof thereby forming a stepped wall. The actuator provides a stepped portion to cooperate with the stepped wall of the housing. Therefore, the stepped portion is adapted to interlock with the stepped wall to position the actuator to press a flexible printed circuit board against the contacts.

The engagement between the stepped wall of the housing and the stepped portion of the actuator is not as reliable as desired since tolerance and friction therebetween are potential danger.

Hence, an improved electrical connector is required to overcome the disadvantage of the prior art.

BRIEF SUMMARY OF THE INVENTION

A first object of the present invention is to provide a connector for connecting with a flexible printed circuit board which has improved retention means for securing an actuator of the connector to press the printed circuit board against a plurality of terminals of the connector.

To achieve the above-mentioned object, a connector includes an elongate housing and an actuator attached to the housing.

The housing receives a plurality of terminals therein and defines a slot for receiving a FPC. The housing includes a top wall, a bottom wall, and a pair of upright supporting walls intersecting the top wall and the bottom wall. The bottom wall forms a pair of outwardly projecting ribs at lateral ends thereof. Each supporting wall includes a top shoulder, a lower shoulder and a recess between the shoulders. A projection outwardly extends from each top shoulder and an aperture is defined in an inward side of each recess.

The actuator consists of a handle, a pair of arms extending from lateral ends of the handle, a pressing plate extending from the handle and a pair of latches perpendicularly projecting from junctures of each arm and the handle. An embossment is formed on a free end of each latch.

The actuator is pushed from a front side of the housing, in assembly, while the arms extend along the recesses until the pegs of the arms are received into the apertures. In use, the arms are retained in the recesses by the projections and embossments of the latches interlocking with the ribs thereby reliably securing the pressing plate press the flexible printed circuit board against the terminals.

Other objects, advantages and novel features of the invention will become more apparent from the following detailed description of the present embodiment when taken in conjunction with the accompanying drawings.

DETAILED DESCRIPTION OF THE INVENTION

Figure 1:
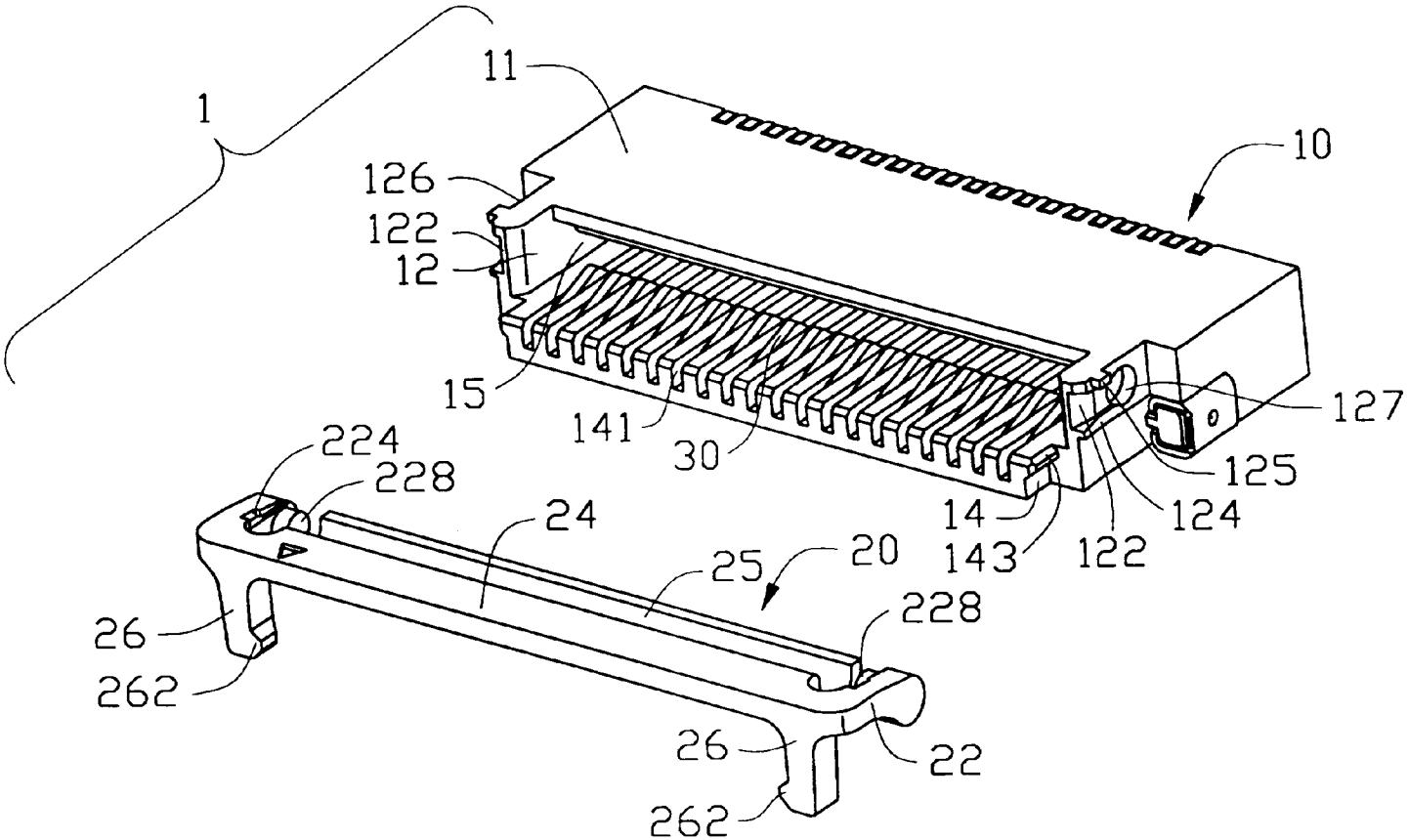
FIG. 1 is a partially exploded view of the present invention.
Figure 2:
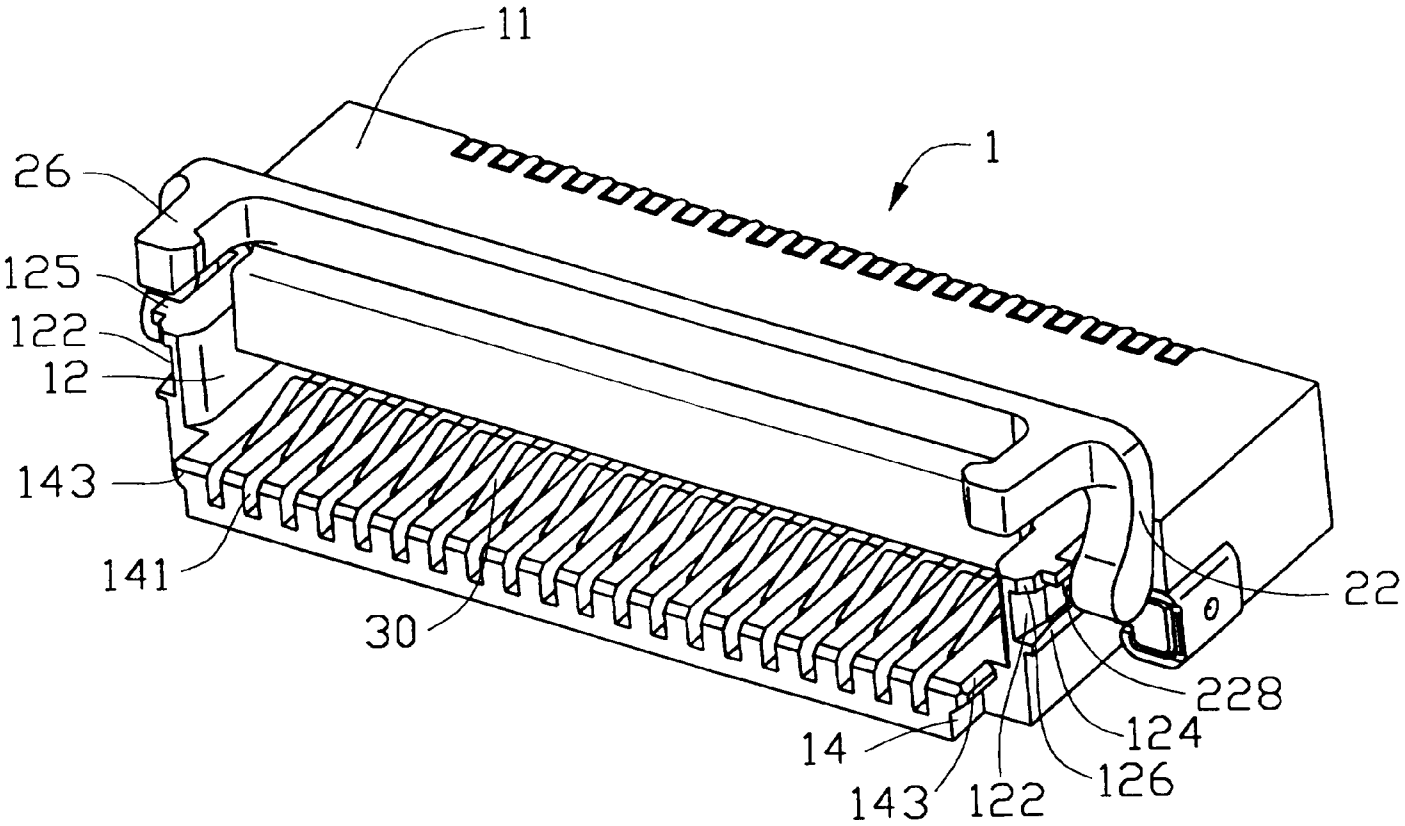
FIG. 2 is a perspective view of FIG. 1 showing a actuator in an open position.

Referring to FIGS. 1 and 2, an electrical connector 1 comprises an elongate insulative housing 10, an elongate actuator 20 pivotally attached to the housing 10, and a plurality of terminals 30 secured in the housing 10.

The housing 10 consists of a longitudinal top wall 11, a bottom wall 14 opposite the top wall 11 and a pair of upright supporting walls 12 perpendicularly interposed between the bottom wall 14 and the top wall 11. A slot 15 is defined within the housing 10 for receiving a flexible printed circuit board (FPC) (not shown). The bottom wall 14 defines a plurality of passageways 141 on an inner side thereof for securing the terminals 30 therein, respectively. A pair of ribs 143 is formed on lateral sides of the bottom wall 14 for latching with the actuator 20.

Each supporting wall 12 has a bottom shoulder 124, a top shoulder 126 and a recess 122 at a forward end thereof. The recess 122 is defined between the bottom shoulder 124 and the top shoulder 126 and is terminated with an aperture 127. A projection 125 extends from an outer side of each top shoulder 126 adjacent a forward end of the top shoulder 126 for retaining the actuator 20.

The insulative actuator 20 is made of a resilient material. The actuator 20 has a pair of arms 22 which form cylindrical pegs 228 projecting inwardly from rearward inner sides thereof for mating with corresponding apertures 127 in the supporting walls 12 and are pivotable in the apertures 127. Each arm 22 further defines a cutout 224 for cooperating with the projections 125. An elongate flat handle 24 connects forward ends of the arms 22 and a pressing plate 25 extending rearwardly from a rearward end of the handle 24. A latch 26 extends downwardly from each juncture of the handle 24 and each arm 22. The latches 26 each form an embossment 262 at a free end thereof inwardly projecting and opposite each other.

Figure 3:
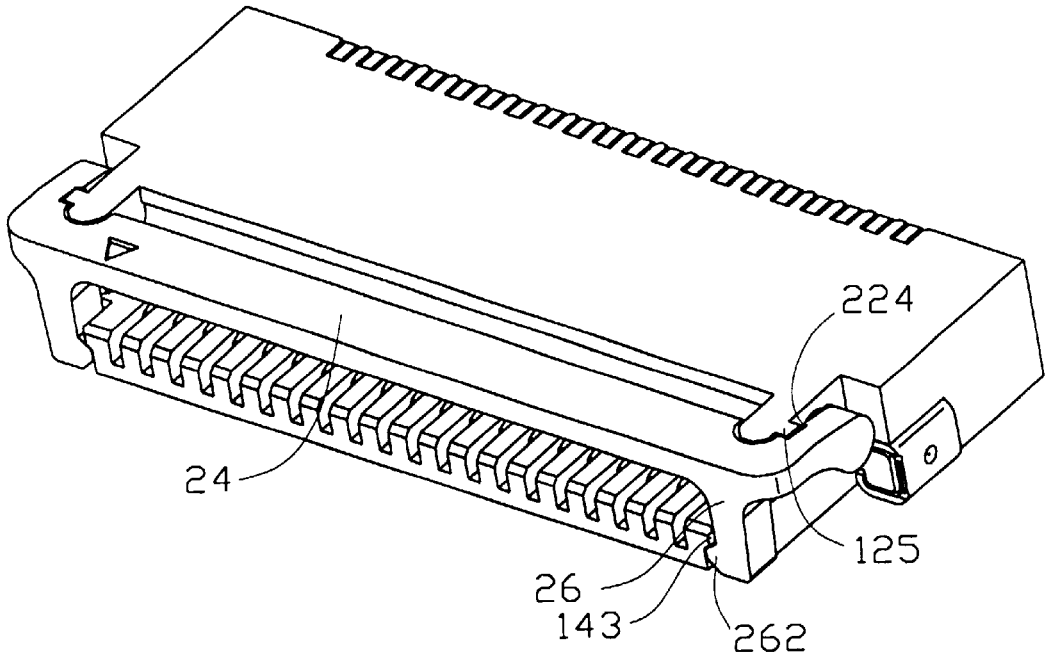
FIG. 3 is similar to FIG. 2 showing the actuator in a closed position.

In assembly, also referring to FIG. 3, the terminals 30 are inserted into the housing 10 and engaged with the passageways 141. The actuator 20 is mounted onto the housing 10 rearwardly from a front side of the housing 10. The arms 22 of the actuator 20 extend along the recesses 122 of the supporting wall 12 until the pegs 228 of the arms 22 fit within the corresponding apertures 127 of the supporting wall 12. The projections 125 engage with the cutouts 224 of the arms 22 while the embossments 262 of the latches 26 simultaneously interlock with corresponding ribs 143.

In use, the embossments 262 are initially disengaged from corresponding ribs 143 and the handle 24 of the actuator 20 is pulled up thereby the arms 22 are withdrawn from between the projections 125 in the recesses 122 and pivotable about the cylindrical pegs 228. The assembled connector 1 is thus opened, as shown in FIG. 2, for an insertion of a flexible circuit board (not shown).

After the flexible printed circuit board (not shown) is inserted into the slot 15 above a contact portion (not labeled) of each terminal 30, the actuator 20 is then pivoted about the pegs 228. The arms 22 pass over the projections 125 of the supporting walls 12 and are then received in the corresponding recesses 122 to reach a closed position as shown in FIG. 3. The pressing plate 25 desirably presses the FPC against the contact portions (not labeled) of the terminals 30.

The connector 1 provides the pair of projections 125 ensuring the actuator 20 to reliably press against the FPC when the thickness of the FPC is a little greater than designed thickness thereof, even though the thicker FPC applies greater force to the actuator 20. Furthermore, the projections 125 will force the actuator 20 in position during accidental force occurring to the latches 26 to disengage the embossments 262 from the ribs 143 whereby the pressing plate 25 maintains an engagement with the inserted FPC.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising an insulative housing, a plurality of terminals secured in the housing and an actuator pivotably attached to lateral sides of the housing, the housing including a top wall, a bottom wall opposite to the top wall, a pair of supporting walls extending upwardly from the bottom wall and connecting the top wall, and a slot in the housing receiving a flexible printed circuit board, the actuator including a pair of arms, each arm having a peg, a handle connecting ends of the arms, a pressing plate extending from the handle for pressing against the flexible printed circuit board inserted into the slot, and a pair of latches projecting from junctures of the handle and each arm, the improvement being in that:

each supporting wall defines at a forward end thereof a top shoulder, a lower shoulder, and a recess extending between the top shoulder and the lower shoulder and terminated with an aperture, said pegs mating with said apertures and said arms being received within the recesses when the connector is at a closed position, in which the pressing plate pressing against the flexible printed circuit board;

wherein each top shoulder has an outwardly extending projection for retaining the arm in the recess;

wherein each arm defines a cutout for cooperating with the corresponding projection to securely retain the arm in position;

wherein the bottom wall forms a pair of ribs on outer sides thereof and each latch has an embossment on an inner side thereof for interlocking with the corresponding rib;

wherein the pegs are received in the corresponding apertures and the embossments interlock with the corresponding ribs, ensuring that the pressing plate presses the flexible printed circuit board against the terminals.

* * * * *